US008332976B1

(12) United States Patent
Goldwater

(10) Patent No.: US 8,332,976 B1
(45) Date of Patent: Dec. 18, 2012

(54) INTERCHANGEABLE ADAPTABLE BED SHEET CONFIGURATION

(76) Inventor: Lisa Goldwater, Laveen, AZ (US)

( * ) Notice: Subject to any disclaimer, the term of this patent is extended or adjusted under 35 U.S.C. 154(b) by 91 days.

(21) Appl. No.: 12/927,365

(22) Filed: Nov. 12, 2010

Related U.S. Application Data

(60) Provisional application No. 61/281,304, filed on Nov. 16, 2009.

(51) Int. Cl.
*A47G 21/00* (2006.01)

(52) U.S. Cl. ..... 5/484; 5/496

(58) Field of Classification Search ..... 5/482, 486, 5/488, 496, 498
See application file for complete search history.

(56) References Cited

U.S. PATENT DOCUMENTS 4,653,131 A 3/1987 Diehl
4,922,565 A 5/1990 Blake
5,070,561 A * 12/1991 Keidser ..... 5/482
5,537,952 A 7/1996 Devlin
5,557,814 A * 9/1996 Cybulski ..... 5/496
6,651,278 B2 11/2003 Ghanem
6,739,002 B1 * 5/2004 Pannu ..... 5/494
6,859,962 B2 3/2005 Diak/Ghanem
7,120,952 B1 10/2006 Bass et al.
8,082,612 B2 * 12/2011 Saunders ..... 5/499

* cited by examiner

*Primary Examiner* — Fredrick Conley
(74) *Attorney, Agent, or Firm* — Harpman & Harpman

(57) ABSTRACT

A multiple configured integrated bedding system that is removably secured over the bed mattress by multiple adjustable different length straps or additional bed frame engagement strap and fasteners. The bedding system provides for different cover and top sheet configurations including, but not limited to cover sheets have permanent or removable interchangeable top sheets, padded inserts, waterproof inserts and retaining perimeter cover lip with a variety of interfastener adaptive sheet restraints and fastening elements.

8 Claims, 7 Drawing Sheets

INTERCHANGEABLE ADAPTABLE BED SHEET CONFIGURATION

This application claims benefit of U.S. Provisional Application No. 61/281,304, filed Nov. 16, 2009.

BACKGROUND OF THE INVENTION

1. Technical Field

This invention relates to mattress covers and the like that are selectively secured over an existing mattress to impart different surface advantages such as padding and moisture proof surfaces.

2. Description of Prior Art

Prior are devices of this type are numerous and varied, see U.S. Pat. Nos. 4,653,131, 4,922,565, 5,537,952, 6,651,278, 6,859,962 and 7,120,952.

U.S. Pat. No. 4,653,131 is directed to a bed sheet restraint having a fabric sheet with a number of attached fastening straps extending therefrom for attachment to the frame of the bed to restrain the user in the bed.

U.S. Pat. No. 4,922,565 discloses a moisture proof sheet having a bottom sheet fitted on the mattress with fastener strips on its surface to retain a second moisture proof sheet.

U.S. Pat. No. 5,537,952 illustrates a pet sheet cover that overlies the mattress and bedding for user isolation of a pet thereon.

U.S. Pat. No. 6,651,278 claims a bed sheet releaseably secured to integrated panels of liquid proof moisture in selected sections thereof.

U.S. Pat. No. 6,859,962 is drawn to a quick change bed sheet having a set of sheets with upper and lower panels. The sheets include a water proof panel with a removable overlying sheet.

Finally, U.S. Pat. No. 7,120,952 discloses an incontinence protective device of a filled disposable configuration with an impermeable layer bonded to an absorbent surface layer that can be positioned on the bedded of the user.

SUMMARY OF THE INVENTION

A comfortable protective adaptable portable bedding system that provides an easy to place and removable bedding that is retained on the bed mattress by adjustable engagement straps and provides permanent and interchangeable multiple top and bottom sheet surface configurations. The system has adjustable straps, padding insert sections; absorbent insert options, waterproof insert options, as well as waterproof sheets with enhanced lip retention and removal insert criteria. Interchangeable sections are provided for select positioning on the bottom sheet by independent integrated multiple configured fastener configurations.

DETAILED DESCRIPTION OF THE INVENTION

Figure 1:
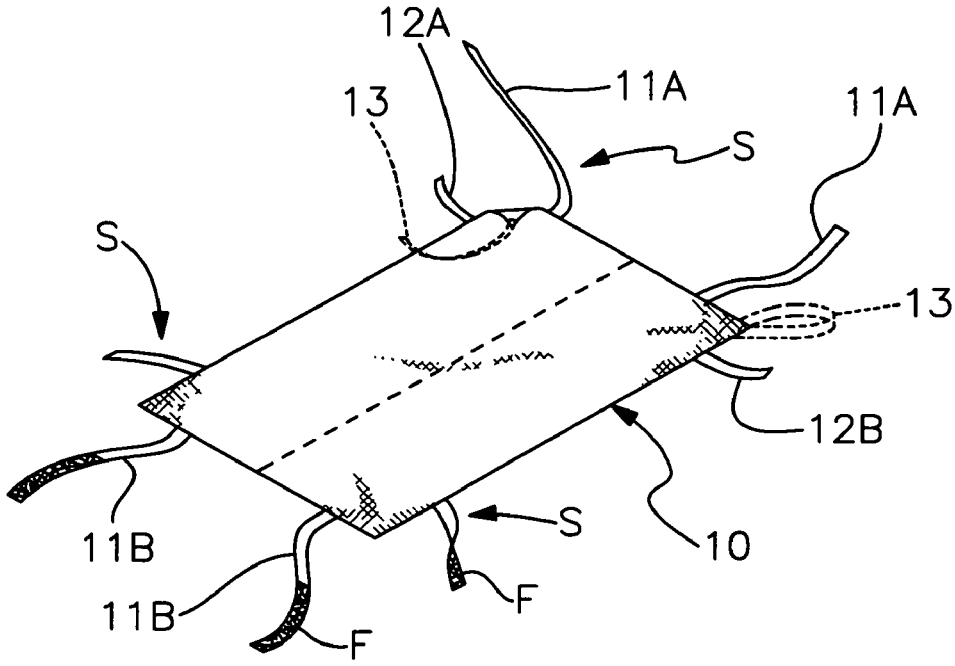
FIG. 1 is a perspective view of the basis bottom sheet form of the invention, exhibiting variable engagement straps.
Figure 2:
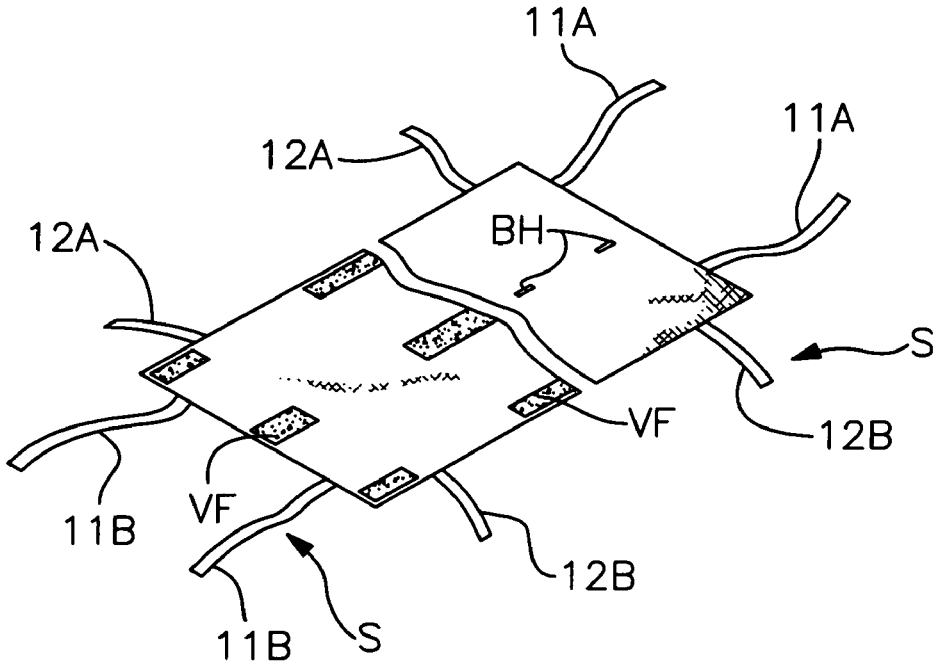
FIG. 2 is a perspective view of the bottom sheet with portions broken away illustrating different attachment fastener configurations for insert sections attachment.
Figure 3:
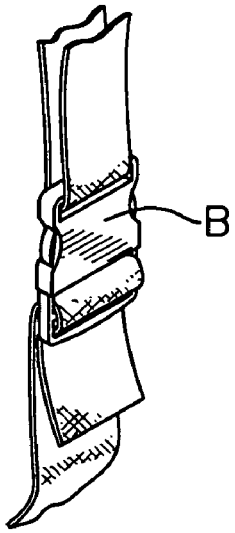
FIG. 3 is an enlarged perspective view of a secondary fastener engagement element associated therewith.
Figure 4:
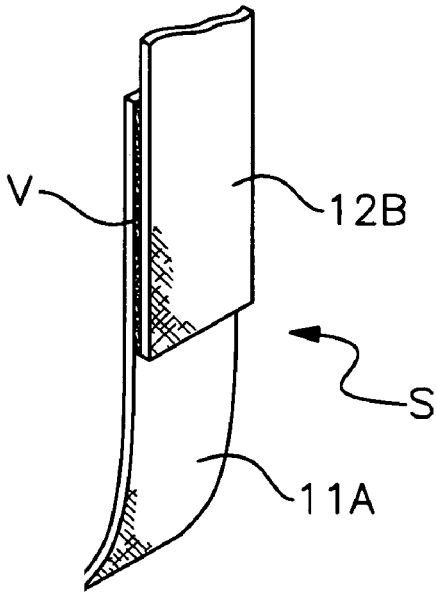
FIG. 4 is an enlarged perspective view of primary attachment fastener system.
Figure 5:
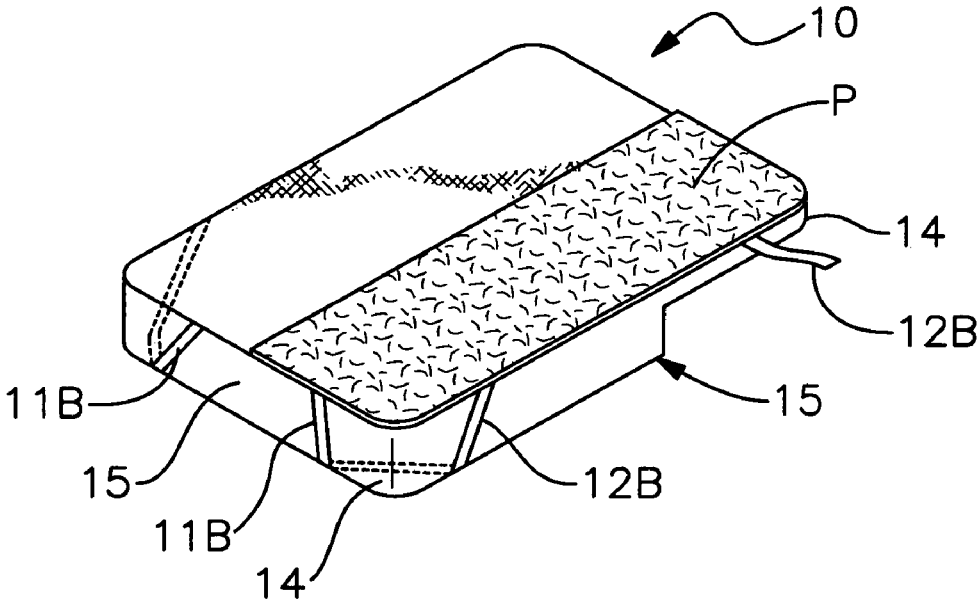
FIG. 5 is a perspective view of an alternate basis bottom sheet engaged on a mattress.

Referring to FIG. 1 of the drawings, basic bottom sheet configurations 10 of the bedding sheet system of the invention can be seen having multiple long respective mattress engagement retainment strap top and bottom sets 11A and 11B, and short right and left side sets 12A and 12B with an optional bed frame end engagement retainment straps 13. The engagement strap sets 11 and 12 are selectively secured to one another once engaged under and about the respective corners 14 of the bed's mattress 15 as seen in FIG. 5 of the drawings. Engagement strap 13 once engaged about the bed frame corner is secured to itself, as seen in FIGS. 1 and 4 of the drawings. A variety of different strap fastener engagements can be used, such as snaps F', integrated buckles B and hook and loop material "Velcro" (VF) shown in FIGS. 1, 2, 3, and 5 of the drawings. FIG. 2 demonstrates differing attachment fasteners to attach top sections 17 options as described hereinafter.

Figure 6:
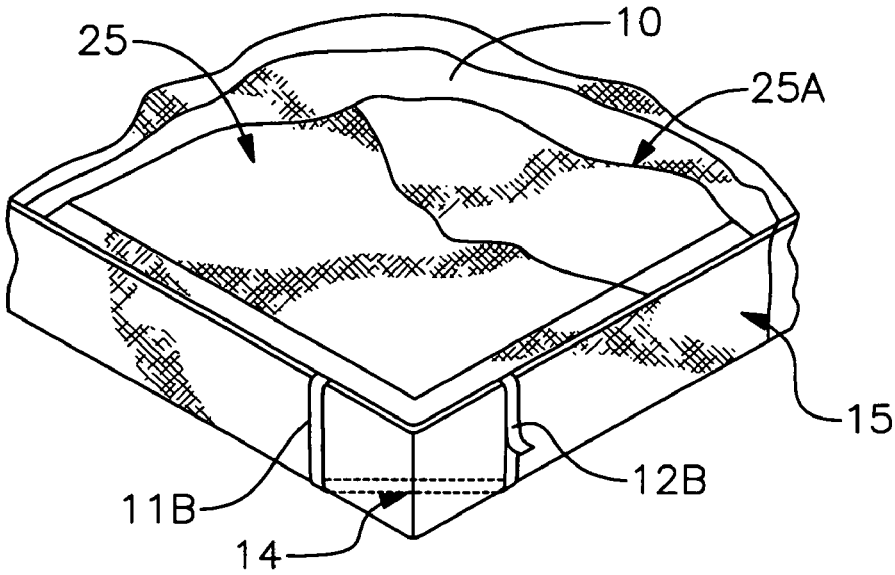
FIG. 6 is a partial perspective view of an alternate bottom sheet with attachment fastener thereon.
Figure 7:
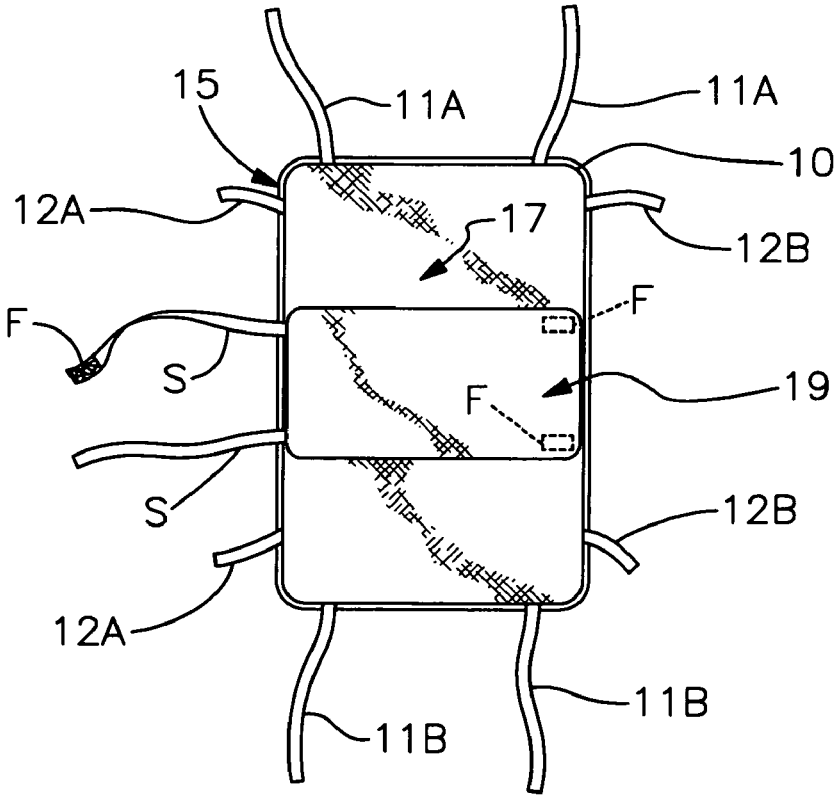
FIG. 7 is a top plan view of an insert section positioning thereon by fasteners and straps.
Figure 9:
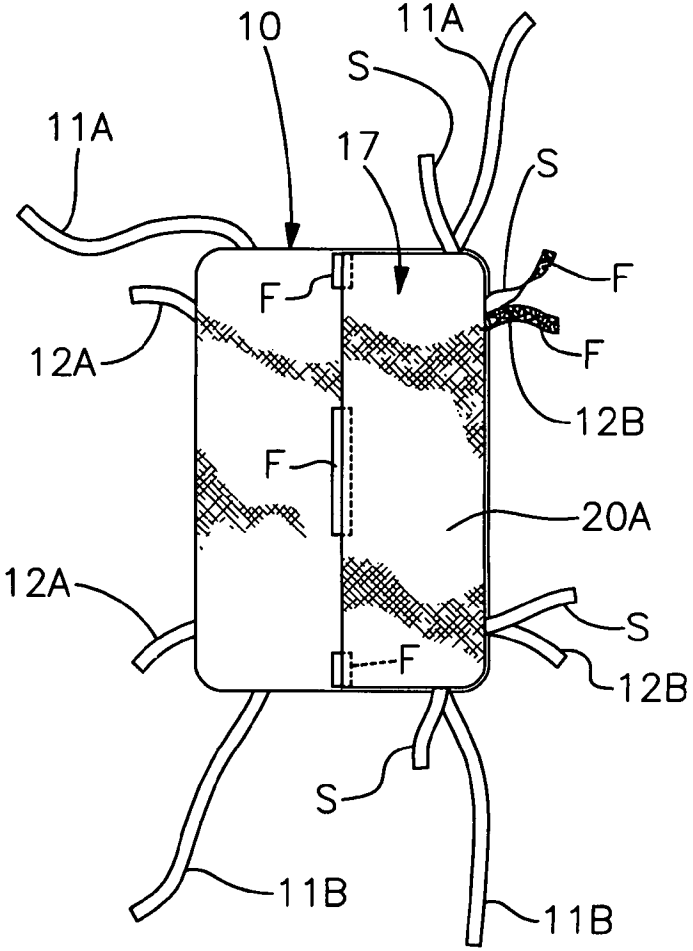
FIG. 9 is a top plan view of an alternate insert section of FIG. 8 positioning by fastener strips and straps.
Figure 8:
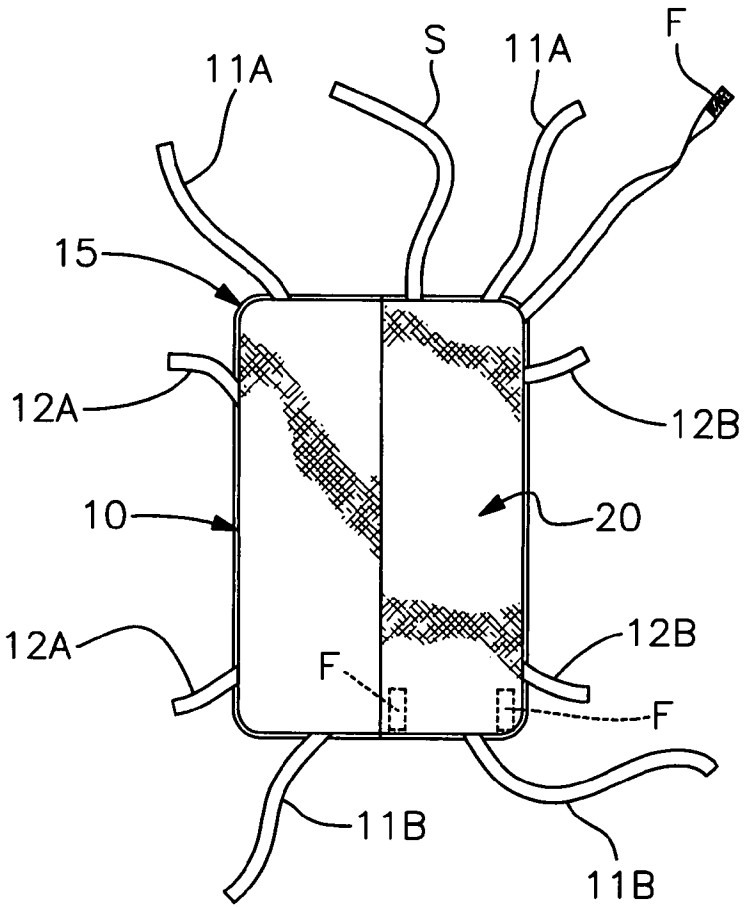
FIG. 8 is a top plan view of an alternate insert section positioning thereon by straps and fasteners.
Figure 11:
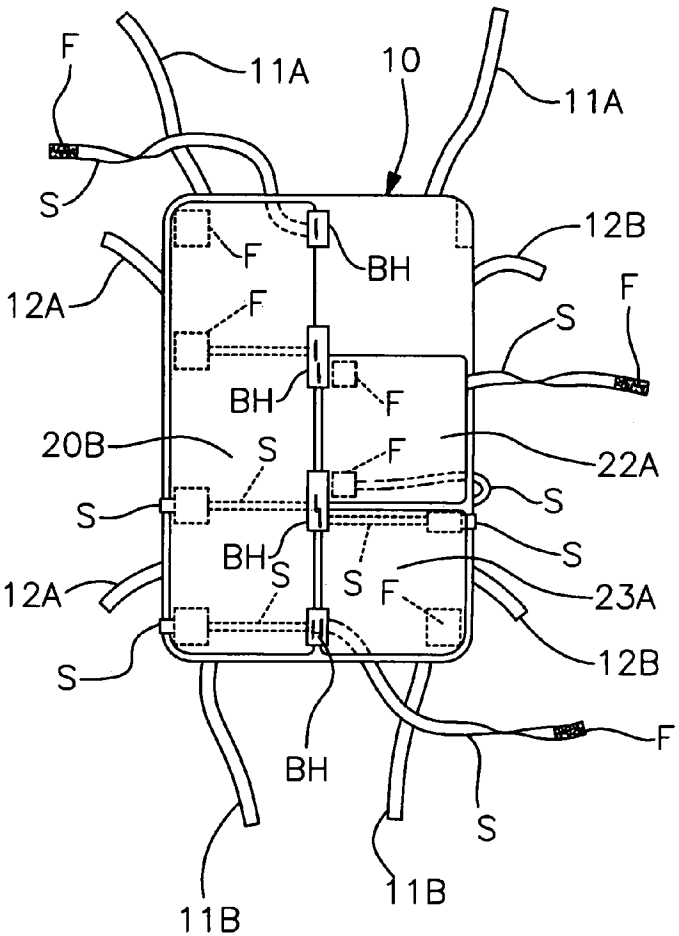
FIG. 11 is a top plan view of an alternate insert section configuration utilizing both large and small insert attachment sheet sections secured by straps and fasteners.
Figure 10:
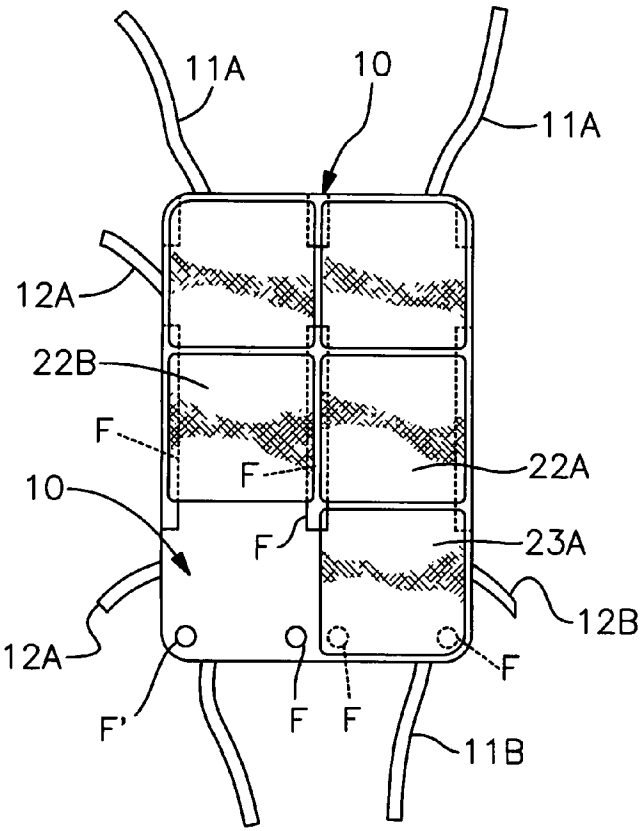
FIG. 10 is a top plan view of an alternate insert section configuration in multiple section inserts secured by fastener strips or snaps.

The primary basic bottom sheet 10 provided in this example, but not limited to, a mounting platform for multiple secondary top section configurations 17 with section inserts as illustrated generally in multiple configuration orientation positions. In this form of the invention interchangeable sheet top sections 17 can be attached at different select areas dependent on user preference by multiple fasteners Velcro V, F, multiple straps S and fasteners F through button holes BH in adaptive combinations to affect placement on the bottom sheet so configured. Examples illustrated are a single cross center section 19 attached by straps S and fasteners F in FIG. 7 of the drawings, or a single side section 20 in FIG. 8 and 20A in FIG. 9; attached by fastener F and straps S in FIG. 8, and fastener strips F, fasteners F and straps S in FIG. 9 of the drawings. Alternate configurations such as independent top sections 21A and 21B, center sections 22A and 22B and a bottom section 23A are illustrated in FIG. 10 of the drawings. Different selected sections as center 22A. bottom 23A and side 20B can be added which can be of a variety of different configurations as generally illustrated in FIG. 11 of the drawings. Additionally, sewn in sections are configured to provide multiple vertical and horizontal sections of different configurations including, but not limited to padding P in FIG. 5 and waterproof forms in FIGS. 6 and 12.

An optional independent waterproof sheet 25 can be used independently with fastener straps or removably attached to the hereinbefore described bottom sheet 10. Attachment is achieved using a reversible fastener format using interlocking hook and loop material V on the engagement straps. It will be evident that the waterproof sheet 25 may be attached to the top of the bottom sheet 10 and although it could be slept upon given the addition of lightweight material 25A, it was intended to be primarily used under bottom sheets of conventional and more luxurious fabrics. It will be seen as with other optional sheet top sections 17 in a reversible fastener format by use of interlocking hook and loop material strips on perimeter edges, straps and sections that top and bottom surfaces can be utilized. It will be evident from the above description that the adaptive strap fasteners can be used in which secondary attachment criteria can be achieved in overlapping, under extending and adjacent co-planar orientation and not be limited thereby well within the scope of the hereinbefore described fastener attachment configurations.

The use of separate waterproof sheets 25, as noted; provide waterproof material cover with lightweight fabric 25A adding comfort and preventing slippage if used under a common sheet or this product's bottom sheet. Such construction would be by both layers sewn and bound around their perimeter edges together.

Figure 12:
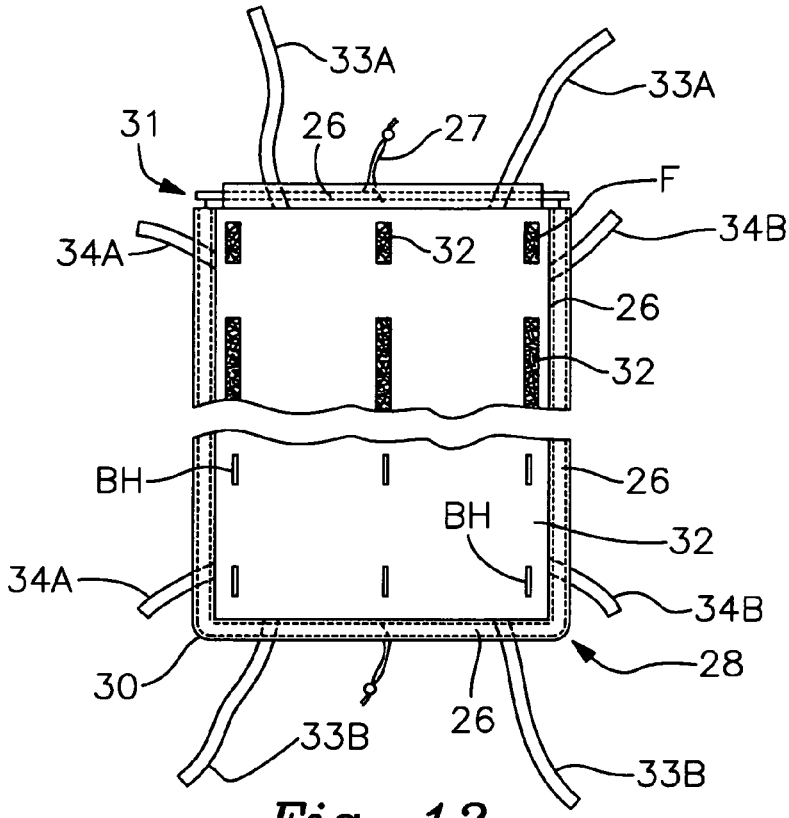
FIG. 12 is a top plan view with portions broken away showing alternate waterproof sheet insert with lip configuration in multiple forms.
Figure 13:
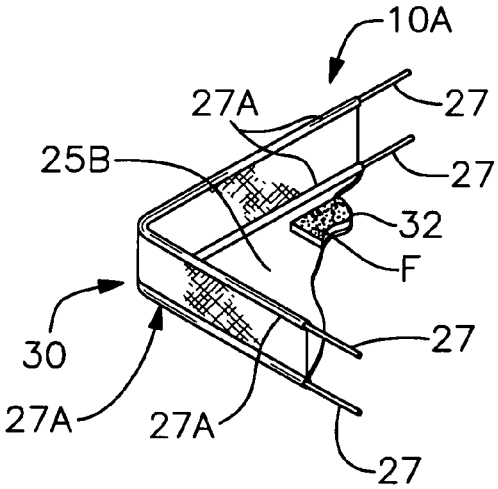
FIG. 13 is a partial perspective view of a corner configuration of the waterproof lip sheet.
Figure 14:
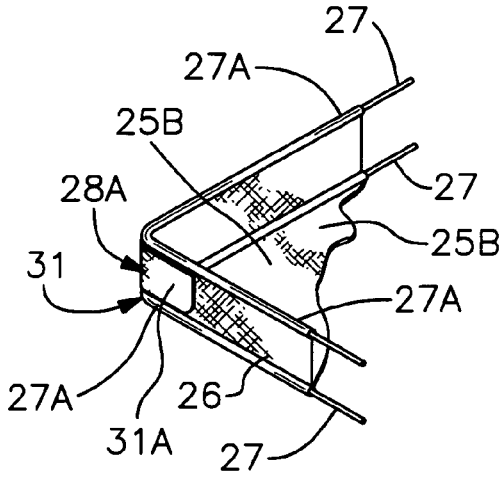
FIG. 14 is a second alternate form of a corner fastener of the waterproof lip sheet of the invention.

Referring now to FIGS. 12, 13 and 14 of the drawings, an alternate waterproof sheet 25B can be seen with a fabric lip 26 defining its perimeter edge as an optional attachment or independent attachment to the mattress or the bed frame. The waterproof sheet 25B allows for a "bottom sheet" to be inserted within the waterproof sheet field without interfering with the operational function of the lip 26. The sheet 25B has a variety of forms which illustrate the upstanding edge lip portion 26 that is derived by outer and inner perimeter drawstrings 27 within channels 27A so as to be "drawn" to gather the lip edge material pulling same forming the upstanding lip 26 as a perimeter water and moisture barrier. Multiple corner configurations can be seen at 28A so as to be rounded integrally at 30 or alternately as a square corner at 31 which is formed having an attachment fastener tab 31A. To provide placement retention of selected "bottom sheet", the waterproof sheet 25B field may have a plurality of fasteners 32 attached to the top side and/or the lip top and underside. Multiple long top and bottom engagement strap sets 33A and 33B and short side engagement straps 34A and 34B respectively topsides thereof provide a retainment pattern hereinbefore described in the primary form of the drawing.

Figure 15:
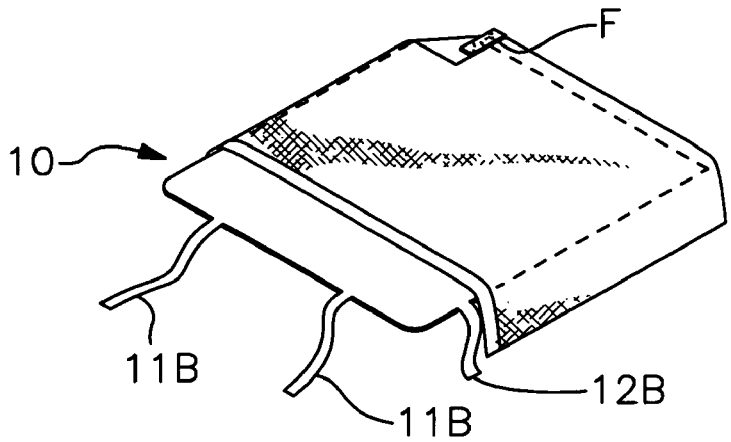
FIG. 15 is a perspective view showing the addition of the top sheet to the bottom sheet.
Figure 16:
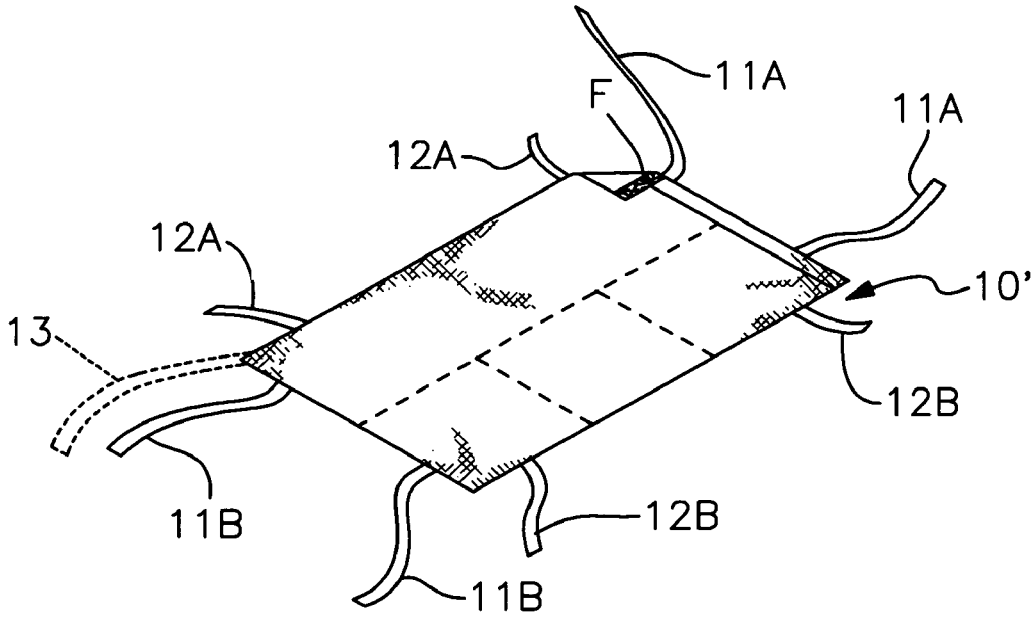
FIG. 16 is a perspective view revealing both bottom sheet under and topside for use with removable top sheet.

Top sheets of various configurations, as seen in FIGS. 15, 16, and 17 attached to bottom sheet 10, of varying configurations permanently or removably using a variety of fasteners such as, but not limited to hook and loop Velcro, snaps, and magnetic snaps (not shown).

It will be evident from the foregoing descriptions that a universal multiple configured bedding sheet system has been illustrated and disclosed that it will be evident to those skilled in the art that various changes and modifications may be made therein without departing from the spirit of the invention.

Therefore I claim:

1. Adaptable, portable multiple bed sheets for covering a mattress having a top surface, a bottom surface and upstanding sides, said bed sheets comprising in combination, a basic bottom sheet of a size adapted to cover the top surface of the mattress, retainment strap sets extending from opposing parallel edges of said bottom sheet in spaced relation to respective corners of said mattress, multiple top section sheets removably secured to said bottom sheet by interengagement fastener means, said top section sheets are of different multiple dimensional configurations less than that of said known surface dimension of said bottom sheet overlying only a portion thereof when so selectively and removably engaged thereon, said retainment strap sets of unequal length having inner engaging retaining elements on their respective free ends for alternate engagement about said respective corners of said mattress.

2. The adaptable, portable bed sheets set forth in claim 1 wherein some of said top section sheets are waterproof.

3. The adaptable, portable multiple bed sheets set forth in claim 1 wherein said interengagement fastener means comprises, hook and loop material, secondary straps extending from said top section sheets, co-registering mechanical strap fasteners.

4. An adaptable, portable bedding waterproof cover sheet for a mattress, said waterproof cover sheet comprising, a cover of a size adapted to initially extend beyond the top surface of said mattress, multiple retainment straps extending from and secured inwardly along opposing parallel edges of said waterproof cover sheet and a perimeter edge strip thereabout, drawstrings within spaced parallel channels in said perimeter edge strip, an upstanding perimeter edge lip defined by foreshortening said drawstrings within said channels of said perimeter edge strip, attachments for removably securing multiple top section sheets within a surface field defined by said upstanding lip of said waterproof cover sheet.

5. The adaptable, portable bedding waterproof cover sheet set forth in claim 4 wherein said attachments for removably securing multiple top section sheets within said surface field comprises, inter-opposing surface engagement hook and loop material, mechanical snap fasteners, and secondary straps.

6. The adaptable, portable bedding waterproof cover sheet set forth in claim 4 wherein said multiple mattress engagement straps are of different opposing lengths for adjustable interengagement to one another about the respective corners of said mattress.

7. The adaptable, portable bedding waterproof cover sheet set forth in claim 4 wherein said perimeter edge strip extends continuously having rounded continuous corner configurations.

8. The adaptable, portable bedding waterproof cover sheet set forth in claim 4 wherein said perimeter edge strip is segmented in oppositely disposed parallel portions, having rectangular segmented corner configurations with overlapping fastener tabs extending therebetween.

* * * * *